United States Patent [19]

Yant

[11] Patent Number: 4,812,076

[45] Date of Patent: Mar. 14, 1989

[54] ASPHALT HOPPER HEATING SYSTEM

[76] Inventor: Robert M. Yant, P.O. Box 28434, Sacramento, Calif. 95828

[21] Appl. No.: 895,118

[22] Filed: Aug. 11, 1986

[51] Int. Cl.[4] ..... E01C 19/00; E01C 23/14

[52] U.S. Cl. ..... 404/108; 404/109; 404/95

[58] Field of Search ..... 404/77, 79, 83, 95, 404/108, 111, 109; 239/129; 126/271.2 A, 343.5 A; 222/146.2; 105/247

[56] References Cited

U.S. PATENT DOCUMENTS

| | | | |
|---|---|---|---|
| 1,033,038 | 7/1912 | Saybolt | 404/111 X |
| 1,397,045 | 11/1921 | Finley | 404/111 X |
| 1,544,438 | 6/1925 | Fetter | 404/95 |
| 1,669,614 | 5/1928 | Hext | 126/271.2 A |
| 1,702,690 | 2/1929 | Gregg | 404/111 X |
| 2,225,481 | 12/1940 | Lundbye | 404/108 |
| 3,499,678 | 3/1970 | Richler | 126/343.5 A X |
| 3,537,443 | 11/1970 | Becker | 126/343.5 A |
| 3,967,913 | 7/1976 | Gabriel | 404/109 |
| 4,175,885 | 11/1979 | Jeppson | 404/77 |
| 4,215,949 | 8/1980 | Gabriel | 404/110 |
| 4,252,487 | 2/1981 | Jeppson | 404/95 X |
| 4,347,016 | 8/1982 | Sindelar et al. | 404/95 |
| 4,557,626 | 12/1985 | McKay et al. | 404/95 |
| 4,623,279 | 11/1986 | Smith | 404/94 X |

*Primary Examiner*—Stephen J. Novosad
*Assistant Examiner*—Matthew Smith
*Attorney, Agent, or Firm*—Townsend and Townsend

[57] ABSTRACT

A system for heating the contents of a supply hopper mounted to a pavement patching vehicle. The vehicle has a remotely controlled distribution hopper mounted at the end of an articulated arm. The vehicle exhaust gas is directed to the supply hopper to keep the asphalt therein warm and to the distribution hopper to heat the underlying pavement. The supply hopper is of double wall construction with the heated exhaust gas directed in a circuitous path along the sidewall and the top before passing into the atmosphere.

8 Claims, 2 Drawing Sheets

ASPHALT HOPPER HEATING SYSTEM

BACKGROUND OF THE INVENTION

Vehicles for repairing potholes or other defects in roadways are shown by U.S. Pat. Nos. 3,967,913 and 4,215,949, both to Gabriel. These machines heat the asphalt surrounding the auger in the supply hopper by use of a burner within the auger. The road surface itself is heated through a flame thrower or burner secured to the distribution bucket mounted to the end of an articulated arm.

SUMMARY OF THE INVENTION

The invention is directed to a system for heating the contents of an asphalt supply hopper of the type mounted to a pavement patching vehicle. The vehicle is of the type including a remotely controlled distribution hopper mounted at the end of an articulated arm.

The exhaust gas from the vehicle's engine is used to heat the contents of the supply hopper and to heat the pavement being repaired at the distribution hopper. This is accomplished by directing the exhaust gas to the distribution and supply hoppers along two paths. One includes an articulated exhaust gas conduit having sections mounted to and corresponding in length to the articulated arm. The end of the articulated conduit forms a downwardly directed nozzle. Exhaust gas from the engine can be directed downwardly into a pothole underlying the distribution hopper to heat the pothole and any asphalt deposited therein.

The other exhaust path extends along a hollow support arm, pivotally mounted to the supply hopper, which supports the supply hopper. The support arm has an outlet which mates with an opening in the wall of the supply hopper when the supply hopper is in its raised position.

The supply hopper is of double-wall construction. The region between the two walls of the supply hopper has appropriately placed barriers so to create a heating conduit which directs the heated exhaust gas in a circuitous path to heat the contents of the supply hopper. The heated exhaust passes along the sidewall from one end and then back, after which it moves into the region between the inner and outer walls of the double walled top. The heated exhaust passes between the walls of the top before passing into the atmosphere through an exit in the top.

One feature of the invention is that it uses otherwise wasted heat from the engine exhaust as a source of heat. The exhaust gas is used to heat the asphalt within the supply hopper. Since it is undesirable to restrict the flow of the exhaust to a great extent, flow paths having a relatively large cross-sectional area are used to reduce the restriction to fluid flow. In addition, the heated exhaust gas can be directed to a hot gas nozzle at the distribution hopper. The fluid path between the engine and the nozzle is also relatively unrestricted so to keep the back pressure to a minimum.

Another feature of the invention is the manner in which fluid connection is made between the exhaust conduit and the supply hopper. This, in the preferred embodiment, is achieved by using a hollow, support arm. The support arm is configured with an outlet which lies adjacent an inlet opening in the supply hopper when the supply hopper is in its raised position. When the supply hopper is in its lowered position the outlet at the end of the support arm is spaced apart from the opening in the supply hopper. However, since this only occurs when refilling the supply hopper, the inability to heat the supply hopper during this time is not important. The double walled end panels and the double walled top of the supply hopper also have aligned openings. When the top is down, the normal configuration, the aligned openings allow the heated exhaust gas to pass directly from the body of the supply hopper into the top of the supply hopper. Again, the only time these two openings are not aligned with one another and sealed is when the top is open, which is not usually the case.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
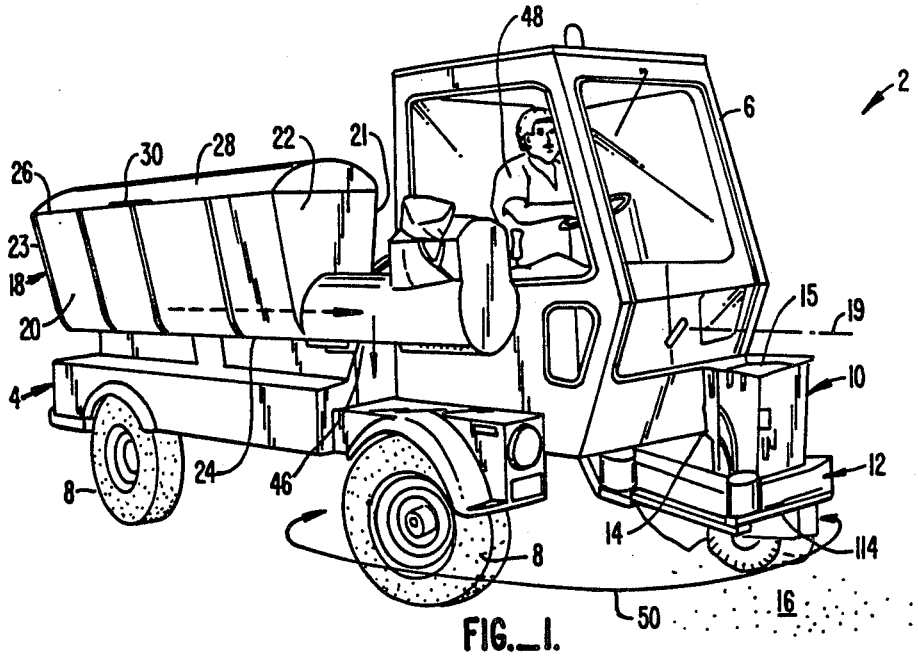
FIG. 1 is a perspective view of a pavement patching vehicle showing the supply hopper in its raised position.
Figure 2:
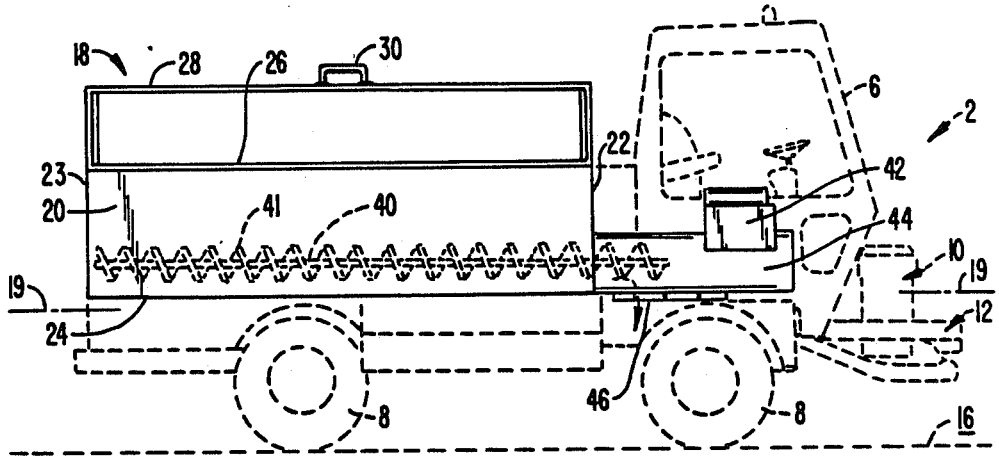
FIG. 2 is a side view of the vehicle in FIG. 1 with the top of the supply hopper partially raised, the balance of the vehicle and the auger shown in dashed lines.

Turning now to FIGS. 1 and 2, an asphalt patching vehicle 2 is shown to include a vehicle body 4 having a cab 6 and four wheels 8. An asphalt distribution hopper 10 is mounted to body 4 below cab 6 by an articulated arm 12. A tamper 14 is mounted to hopper 10 for the remote controlled compaction of asphalt 15 or other paving material discharged from distribution hopper 10 onto surface 16, typically a roadway. A supply hopper 18 is mounted to body 4 along one side of the body generally parallel to the vehicle axis 19. Supply hopper 18 includes elongate, downwardly and inwardly tapering sides 20, 21 and generally vertical ends 22, 23 extending between a bottom 24, shown also in FIG. 3, and an upper edge 26. A top 28, having a handle 30, is pivotally mounted to the upper edge 26 of side 20.

The use of top 28 helps to keep paving material 15 at an elevated temperature while contained in supply hopper 18. As a further aid to keep the temperature of material 15 elevated, exhaust from engine 32, shown in FIG. 3, is supplied to hopper 18 in a manner discussed below.

A pair of augers 40 are mounted within supply hopper 18 just above bottom 24. Augers 40 have flights 41 which wrap in opposite rotary directions. Augers 40 are rotated in opposite rotary directions by a drive 42 mounted to an extension 44 of hopper 18 extending from front end 22. Extension 44 has a discharge opening 46 along its bottom for the discharge of paving material 15 into distribution hopper 10, distribution hopper 10 having been positioned beneath opening 46 by the operator 48 manipulating arm 12. This movement is indicated by arrow 50 in FIG. 1. This use of a pair of augers 40 moves paving material 15 towards discharge opening 46 also helps to keep the paving material mixed within supply hopper 18.

Figures 3, 4:
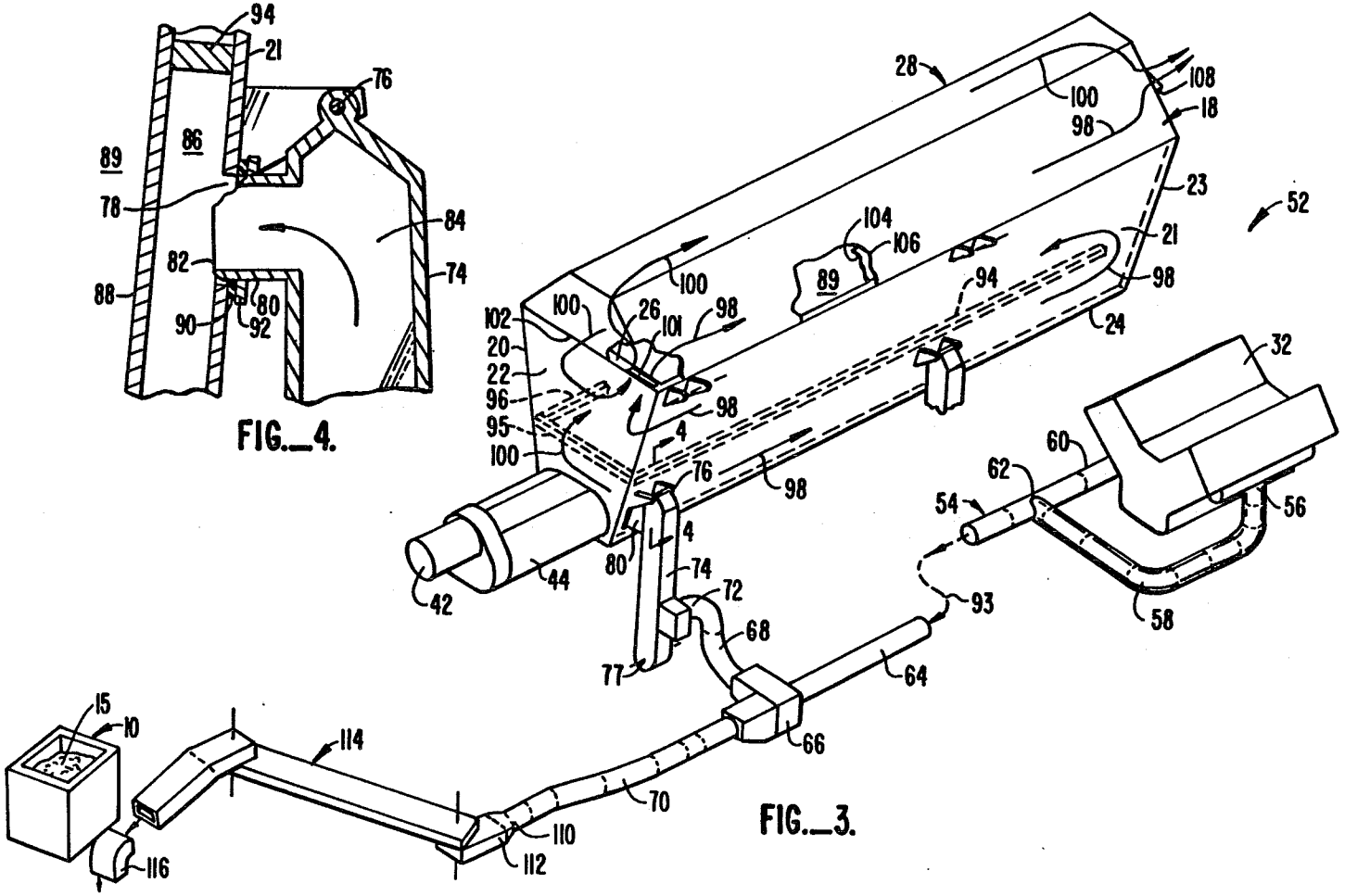
FIG. 3 is a simplified representation of a slightly modified supply hopper in conjunction with the heating system of the invention.
FIG. 4 is a cross-sectional view taken along line 4—4 of FIG. 3.

Referring now to FIG. 3, an exhaust heating system 52 is shown in conjunction with supply hopper 18, distribution hopper 10 and engine 32. System 52 includes an exhaust conduit 54 comprising a pair of inlets 56 connecting engine 32 to conduit sections 58, 60 which meet at point 62. The exhaust gases from engine 32 thus pass from the engine through conduit sections 58, 60 and into a common conduit 64. Conduit 64 opens into a flow controller 66 which controls the relative proportions of flow of exhaust from common conduit 64 into first and second conduit 68, 70.

First conduit 68 is connected at its end 72 to the interior of a support arm 74, arm 74 being pivotally mounted to side 21 of supply hopper 18 at a pivot 76 and to vehicle body 4 at pivot 77. Referring now also to FIG. 4, side 21 is seen to include a heating conduit entrance 78 adjacent a complementarily sized extension 80 of support arm 74. As illustrated in FIGS. 3 and 4, when supply hopper 18 is in its raised position, end 82 of extension 80 fits within entrance 78 to provide fluid communication between the interior 84 of support arm 74 and the region 86 between side 21 and an interior wall 88 of supply hopper 18. By virtue of this double wall construction of supply hopper 18, heated exhaust from engine 32 is used to heat the asphalt or other paving material within the interior 89 of supply hopper 18.

The joint between entrance 78 and extension 80 is sealed through the use of a high temperature gasket 90 captured between side 21 and a flange 92 extending from the outer circumference of extension 80 near but spaced back a short distance from end 82. Although this seal is only effective when supply hopper 18 is in its raised position, during normal operation supply hopper is only lowered when it is to be refilled at a main supply terminal. Therefore, during substantially the entire operation of vehicle 2, end 82 of extension 80 will remain sealed with entrance 78 of side 21.

Exhaust flows from engine 32 along exhaust path 93, through flow controller 66, along first conduit 68, through support arm 74 and into region 86. A number of barriers 94, 95, 96 are positioned between side 21, end 22 and side 20 and interior wall 88 to direct the exhaust gas along circuitous paths 98, 100. Path 98 extends parallel to side 21 from end 22 to end 23, reverses direction to extend back towards end 22 and then flows into top 28 through openings 101 along upper edge 26 and an adjacent edge 102 of top 28. The fluid joint at openings 101 is similar to that illustrated in FIG. 4 and will therefore not be shown separately. The heated exhaust gas then passes between the double walls 104, 106 of top 28 and out an exit 108 in top 28. Similarly, path 100 extends from entrance 78, along end 22 from side 21 to side 20, back and forth along side 20, up end 22, through openings 101 and along top 28 in a manner similar to path 98. No intention is made to limit the possible flow paths by describing the flow in terms of two separate flow paths. Such description is for convenience only.

Flow controller 66 can be operated to direct none, all or part of the exhaust along second conduit 70. The outer end 110 of second conduit 70 is coupled to one end 112 of an articulated exhaust conduit 114. Conduit 114 is secured to and below articulated arm 112. Exhaust gas passes from engine 32, through conduit sections 58, 60, common conduit 64, flow controller 66, second conduit 70, articulated exhaust conduit 114 and a hot gas nozzle 116 at the outer end of conduit 114. Nozzle 116 is positioned adjacent distribution hopper 10 and is used to heat a portion of surface 16 prior to depositing asphalt 15 onto the surface and to keep the asphalt warm during tamping operations.

Through the use of the hot exhaust gases from engine 32, the need for supplemental heaters at supply hopper 18 and at distribution hopper 10 are not needed. The heat of the exhaust gas, which would normally be wasted, is used for this purpose thus increasing the operating efficiency of vehicle 2.

Modification and variation can be made to the disclosed embodiment without departing from the subject of the invention as defined in the following claims.

What is claimed is:

1. An asphalt hopper heating system, for use with a pavement patching vehicle used to patch pavement, the vehicle of the type having a supply hopper holding a supply of pavement patching material, the supply hopper mounted to the vehicle for movement between raised and lowered positions, the vehicle including an engine of the type producing a flow of heated exhaust gas from an exhaust port, the system comprising:

the supply hopper having a wall;

the supply hopper including heating conduit means for creating a fluid path in thermal contact with the wall;

a conduit pivotally mounted to the vehicle and to the supply hopper, the conduit and the heating conduit means having complementary mating elements defining openings into the conduit and the heating conduit means, the complementary mating elements forming a substantially sealed joint to fluidly couple the conduit and the heating conduit means only when the supply hopper is in the raised position; and an engine exhaust conduit connecting the conduit and the exhaust port so to permit passage of exhaust gas from the exhaust port, through the exhaust conduit, through the conduit, and through the heating conduit means of the supply hopper when the supply hopper is in the raised position.

2. The system of claim 1 wherein the heating conduit means is formed in part by a double walled construction of the wall.

3. The system of claim 2 wherein the supply hopper includes a sidewall and a top, the top movable between open and closed positions, and wherein the heating conduit means is formed in part by a double wall construction of the top.

4. The system of claim 3 wherein the heating conduit means formed by the double wall construction in the top and sidewall are fluidly coupled by openings in the top and sidewall, the openings lying adjacent one another and when the top is in the closed position so to fluidly couple the heating conduit means in the top and sidewall.

5. The system of claim 1 wherein the heating conduit means provides two passes along a portion of the sidewall.

6. The system of claim 1 further comprising a high temperature seal at the sealed joint.

7. The system of claim 1 wherein the conduit constitutes a hollow pivotal support arm for the supply hopper.

8. An asphalt hopper heating system, for use with a pavement patching vehicle used to patch pavement, the vehicle of the type having a supply hopper holding a supply of pavement patching material, the supply hopper mounted to the vehicle for movement between raised and lowered positions, the vehicle including an engine of the type producing a flow of heated exhaust gas from an exhaust port, the system comprising:

The supply hopper having a bottom, a double-walled sidewall and a double-walled top movable between open and closed positions, the sidewall and top having inner and outer walls and complementary openings opening into the regions between the inner and outer walls, the openings sized and positioned to engage one another when the top is in the closed position;

the supply hopper including heating conduit means, including a hopper exhaust gas entrance and a hopper exhaust gas exit, defined between the inner and outer walls of the double-walled sidewall and top, for creating a fluid path, in thermal contact with the inner walls, between the hopper exhaust gas entrance and the hopper exhaust gas exit; and an exhaust conduit having an inlet end connected to the exhaust port and an outlet end connected to the hopper exhaust gas entrance;

a portion of the exhaust conduit adjacent the outlet end including a hollow support arm pivotally secured to the supply hopper, the support arm having an end configured for mating engagement and fluidly coupled with the exhaust gas hopper entrance when the supply hopper is in the raised position.

* * * * *